United States Patent [19]

Fullenwider

[11] 4,363,674

[45] Dec. 14, 1982

[54] STOVE AND FIREPLACE CLEANING METHOD AND APPARATUS

[76] Inventor: John T. Fullenwider, Rte. 3, 1211 Esther Wy., Minden, Nev. 89423

[21] Appl. No.: 239,505

[22] Filed: Mar. 2, 1981

[51] Int. Cl.[3] ..... B08B 5/04

[52] U.S. Cl. ..... 134/21; 15/301; 110/171; 134/22.1; 134/24

[58] Field of Search ..... 134/21, 22.1, 24; 15/301, 304, 415 R, 415 A, 353; 110/165 R, 171, 266; 126/242, 16; 201/2; 202/241

[56] References Cited

U.S. PATENT DOCUMENTS

| | | | |
|---|---|---|---|
| 1,053,665 | 2/1913 | Spencer | 15/415 |
| 1,465,711 | 8/1923 | Gray | 134/21 |
| 1,589,986 | 6/1926 | Russell | 134/24 |
| 1,887,768 | 11/1932 | Maloney | 110/165 R |
| 1,994,616 | 3/1935 | Leitzell | 134/21 |
| 2,399,884 | 5/1946 | Noack | 110/165 R |
| 2,609,190 | 9/1952 | Jackson | 15/301 |
| 3,416,514 | 12/1968 | Klemme | 126/242 |
| 3,777,330 | 12/1973 | Van Huffel | 15/304 |

FOREIGN PATENT DOCUMENTS

| | | | |
|---|---|---|---|
| 325005 | 9/1920 | Fed. Rep. of Germany | 126/242 |
| 1074900 | 7/1967 | United Kingdom | 15/304 |

*Primary Examiner*—Kenneth M. Schor
*Assistant Examiner*—Michael L. Goldman
*Attorney, Agent, or Firm*—Herbert C. Schulze

[57] ABSTRACT

This invention is a method and apparatus for cleaning stoves, furnaces, fireplaces and the like, which is characterized by a vacuum system having a specially designed pickup member insertable into a stove, furnace, fireplace or the like, in such manner that, when being inserted or removed, ashes and the like, will not escape from the stove, furnace, fireplace or the like, and also which has sufficient protective characteristics that it will not accept large burning objects and the like, and wherein means are provided to drop material evacuated from the stove, furnace, fireplace or the like, into the water or other suitable bath for quenching as required. The method and apparatus incorporate the providing of a specially designed connection opening between the interior and exterior of the stove or the like, which opening and its elements are cooperable with a specially designed vacuum pickup attachment, together with an exterior mounted quenching medium to receive the material evacuated.

2 Claims, 8 Drawing Figures

FIG. 5.
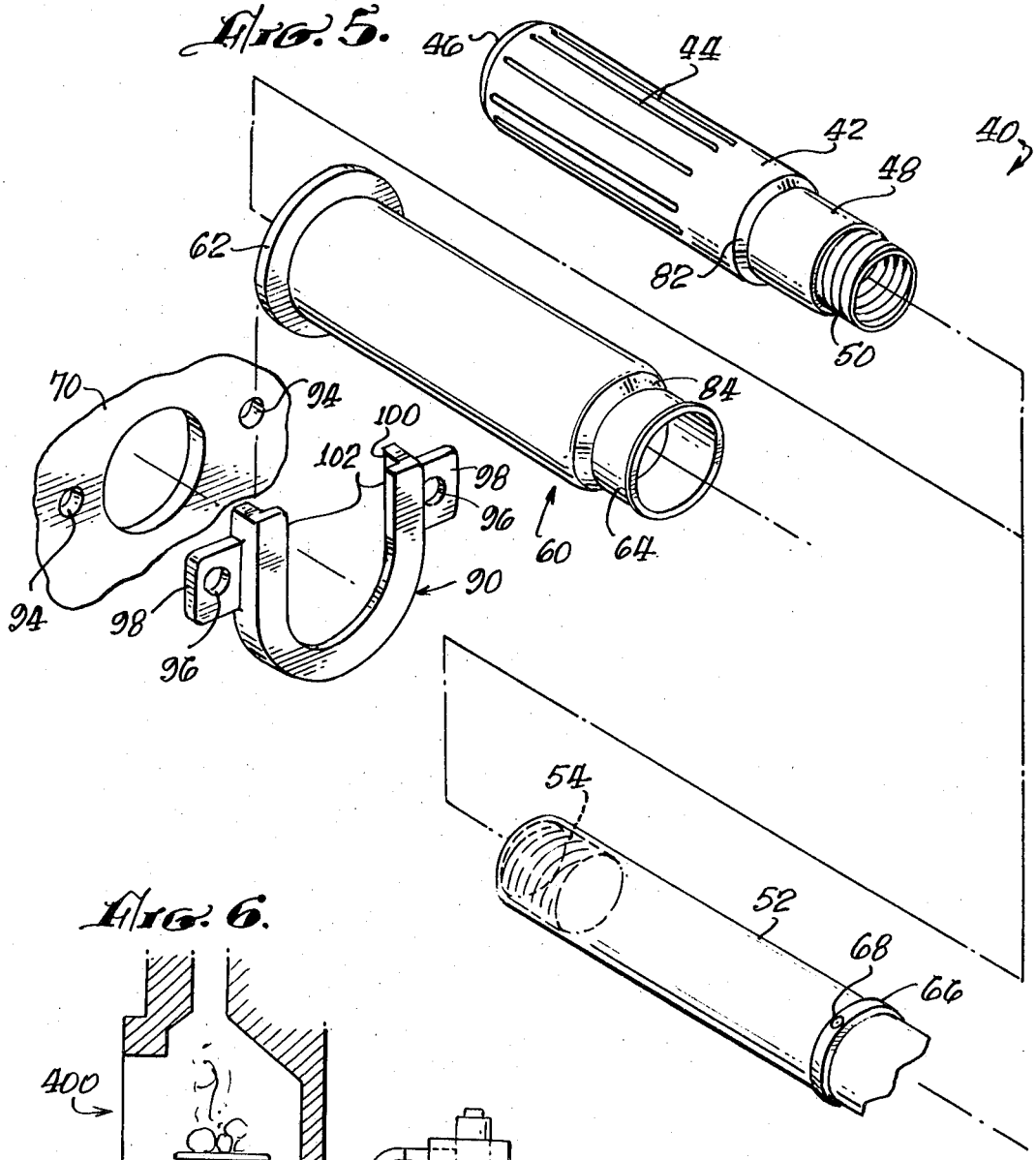
FIG. 6.
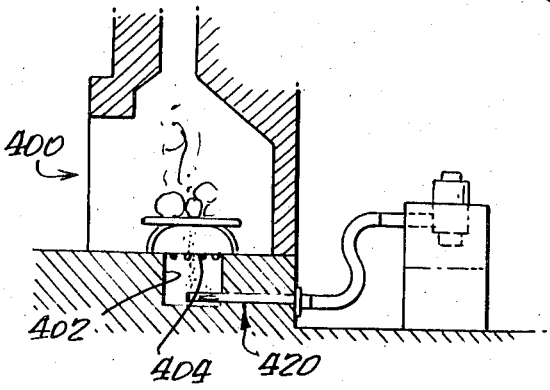
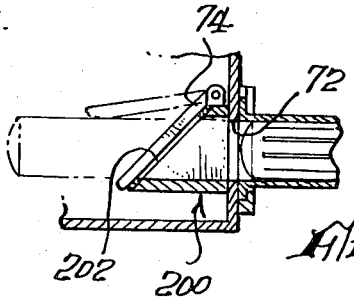
FIG. 7.
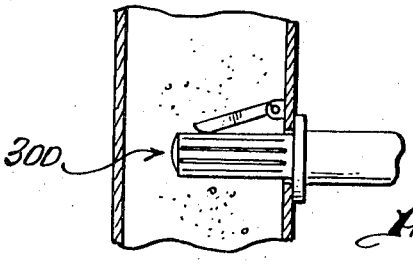
FIG. 8.

STOVE AND FIREPLACE CLEANING METHOD AND APPARATUS

CROSS REFERENCE TO RELATED PATENT APPLICATIONS

There are no patent applications filed by me related to this application.

BACKGROUND OF THE INVENTION

1. Field of the Invention

This invention is in the general field of cleaning systems and is more particularly related to a vacuum cleaning system adapted to be inserted within a stove, furnace, fireplace or other combustion area for the removal of ash and the like, by vacuum rather than from a normal opening such as a door or the like.

2. Description of the Prior Art

There is no prior known to me related to this invention. Vacuum cleaning system, however, are well known for vacuuming carpets, furniture and the like. However, the interconnection of a vacuum system in a safe manner to a combustion chamber has not been accomplished to my knowledge and the features of the interconnecting arrangement as well as the protective nature of the vacuum pickup element are unique to this invention.

SUMMARY OF THE INVENTION

The use of various combustion areas, and particularly those which result in an accumulation of ash and the like, has been growing rapidly in recent years. There is much wood, coal, and the like burned now. Much of this is burned in homes as well as in commercial establishment and is utilized in stoves or the like, for heating purposes, primarily.

The problem is the rapid accumulation of ash which results from this type combustion and the removal of such ash, particularly through living areas and the like, is a considerable problem. Some of the difficulties involved are the spilling of ash and the like, within living areas. An even worse problem is the occasional dropping of a hot coal or burning ember and causing at the very least, a burned area in a carpet or on a floor. Sometimes complete buildings are destroyed as the result of such action.

With the stoves and the like presently being used, most, if not all, of the combustible material, if it remains long enough within the stove is completely consumed. Frequently as the result of incomplete combustion there will be large pieces of charcoal, and the like, which are carried out with the ash and thus their utilization is lost.

I have now devised a method of cleaning stoves and the like, together with an apparatus for practicing the method, wherein removal of ash in a safe and cleanly manner may be accomplished without the removal of incompletely burned material.

I have accomplished this by providing a special opening in the wall of a combustion chamber, with an automatic closure arrangement which causes closure at all times when cleaning is not taking place.

I have provided a special vacuum pickup element insertable through said opening in the proximity of the ash and the like which automatically opens the closure upon insertion and automatically allows closing of the closure upon removal.

This special element connected to a line which extends, preferably, to the exterior of the area in which the stove, or the like is located. This line terminates within a vacuum, or the like, located in a special chamber having a liquid such as water, or the like, suitable to quench any embers which might come through the vacuum system.

It is an object of this invention to provide a method and apparatus for cleaning combustion chambers by vacuum.

Another object of this invention is to provide such a method and apparatus wherein incompletely consumed combustible materials will not be removed.

Another object of this invention is to provide such a method and apparatus wherein danger of fire from the material being removed is eliminated.

Another object of this invention is to provide such a method and apparatus as is defined wherein the ash being removed by vacuum cannot inadvertently escape into the area in which the combustion chamber is located.

The foregoing and other objects and advantages will become apparent to those skilled in the art upon reading the following description of a preferred embodiment in conjunction with a review of the appended drawings.

A BRIEF DESCRIPTION OF THE DRAWINGS

FIG. 5 is an exploded perspective of the elements comprising the assembly of FIGS. 1 through 4;

FIG. 6 is a schematic showing of an alternate embodiment of the invention for use in fireplace construction, and the like;

FIG. 7 is a section similar to FIG. 3 showing an alternate embodiment of gate; and FIG. 8 is a schematic sectional view showing the use of the evacuation system of the invention in an alternate condition.

DESCRIPTION OF A PREFERRED EMBODIMENT

Figure 1:
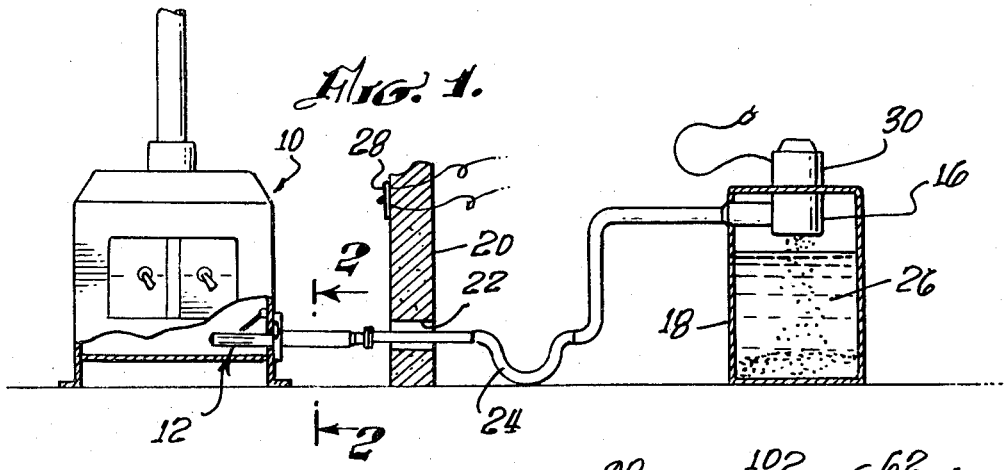
FIG. 1 is a schematic side elevation of an ash evacuation system employed in this invention.
Figure 2:
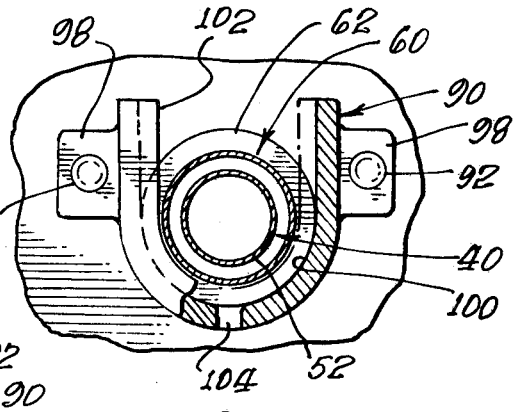
FIG. 2 is an enlarged fragmentary section taken on line 2—2 of FIG. 1 with portions broken away thereof.

I have shown in FIG. 1 a simplified system of ash evacuation and removal from a stove, or the like, and taken to a special treatment unit. A stove, or furnace 10, is shown having the ash evacuation nozzle assembly 12 inserted therein, and a conduit means 14 connecting to a vaccuum 16 housed in a container 18. A structure 20 is provided with an opening 22 in order to allow the conduit 14 to pass therethrough. A flexible portion of a conduit 14, as indicated at 24 allows for a portion of the conduit entering the inside of the structure 20 to be movable.

The ash, having been withdrawn from the stove 10, is taken through the vaccuum unit 16 into a container 18 which is filled with a water or anti-freeze solution 26. The ash is thusly condensed into a smaller volume and kept from being disbursed into the atmosphere within or without the building 20. Vaccuum systems, such as are used in shops for removable of sawdust, can be easily adapted for use in this situation. A switch 28 placed in proximity to the nozzle 12 can be actuated in order to turn on the motor 30 of the vaccuum unit 16. This can also be accomplished by an automatic actuation of a switch when the nozzle is inserted for ash evacuation and turned off when said nozzle has been removed from the vicinity of the ash material.

FIGS. 2 through 5 show the nozzle assembly 40 comprised of a tubular forward portion 42 having slots or openings 44 and a closed end 46. a reduced neck portion 48 having external threaded means 50 is screwed into a receiving tube 52 having internal threads 54 to match the threads 50. This combined tube assembly 42 and 52 slide within a hollow tubular member 60. This tubular member has an enlarged flange 62 and a reduced fitted open end portion 64. A ring or collar 66 is fastened to the member 52 by a set screw 68, or the like. This ring 66 limits the amount of movement of the tubular assembly 42 and 52 as to its movement into a stove 10.

The wall of the stove 70 is provided with an opening 72 and a flap closure 74, pivoted at 76 in order to close the opening 72, when the member 40 has been withdrawn. A seal 78 is provided on the inside of the wall 70 surrounding the opening 72 and provides for sealing of the opening when the unit 40 has been withdrawn.

Figure 3:
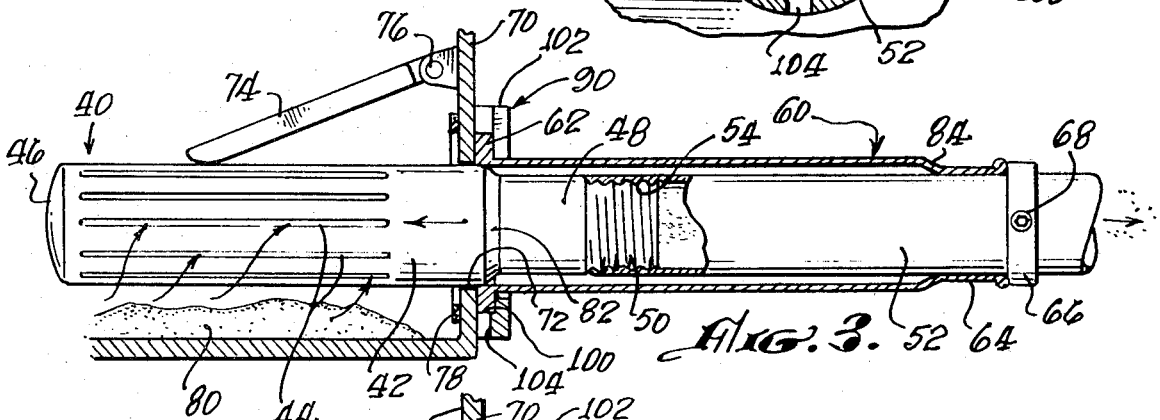
FIG. 3 is a section taken on line 3—3 of FIG. 2 with certain portions in elevation.

FIG. 3 shows the nozzle assembly 40 having been inserted into the ash containing chamber of the stove 10 and in position to draw in the ash accumulation 80.

Figure 4:
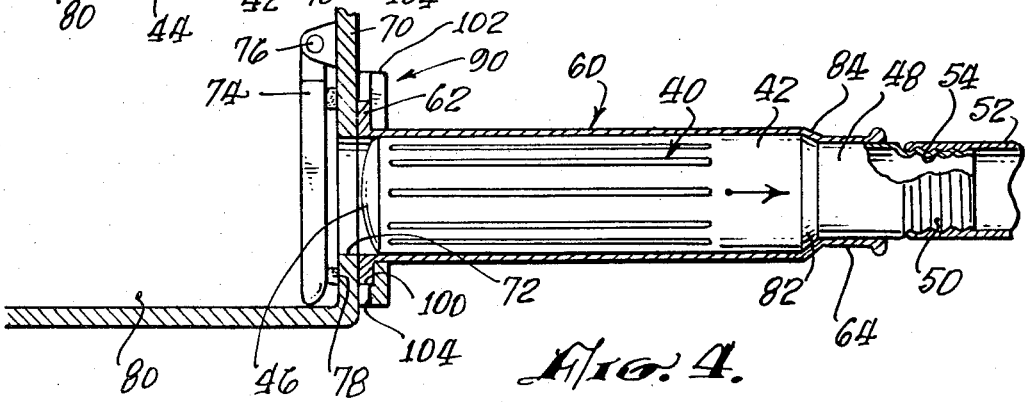
FIG. 4 is a view similar to FIG. 3 showing the device of the invention in another position.

FIG. 4 shows the nozzle assembly withdrawn until the enlarged forward portion 42 has its tapered wall 82 abutting against against corresponding shoulder 84 in the member 60. At this time the flap valve 74 has fallen by gravity or by spring urging its closed condition. At this time the vacuum effect has been stopped and the tube is ready for its next insertion. The tube 52 can be made in any desired length and can be connected by similar fittings to any desired length.

In order to place nozzle into operation a U-shaped receiving bracket 90 is mounted onto the outside of the wall 70 by means of fasteners 92 passing through openings 94 in the stove wall and through receiving openings 96 in tabs 98 which are a part of bracket member 90. The bracket 90 is constructed of an L-shaped section having a receiving channel 100 for the receipt of the flange 62. An open end 102 allows the insertion of the flange into the position shown in FIG. 3. An opening 104 is provided at the bottom of this newly formed channel to allow any accummulated particles of ash to drop out in order to keep the bringing together of the flange 62 into association with the stove wall from any complication. When the member 40 is withdrawn to the position of FIG. 4, it can be seen that the flange can be lifted out of the channel created by the bracket 90 and put away for summer use or taken away for repair.

In FIG. 6 I have shown a fireplace 400 having an ash catching opening 402 beneath the grate 404. In this instance, the nozzle 420 can be inserted into the ash receiving chamber by bringing it from a basement or from an outside area. The disbursal of the ash can be done in a manner similar to that shown in FIG. 1.

In FIG. 7 I have shown an alternate construction for the gate closing member. In this Fig. the gate 74 does not have to rely fully on a vertical position in order to close the opening 72. A box-like construction 200 having tapered side walls 202 allows the closure 74 to come to rest at approximately 45 degrees. The nozzle assembly 240 can easily be put into contact with the ash accummulation and withdrawn in a manner similar to that shown in FIGS. 3 and 4.

FIG. 8 shows a schematic section through a chamber in which dust or smoke is passing or being accummulated. The nozzle assembly 300 is shown in this case being inserted into the flow of such particles and can withdraw any undesired accummulation of such particles within this chamber.

It is to be understood that the material of which the nozzle and conduit assemblies is constructed is such that it would be heat resistant and fire retardant. Various metals, asbestos-type products, and certain clay materials can be used to accomplish this purpose.

While the embodiments of this invention shown and described are fully capable of achieving the objects and advantages desired, it is to be understood that such embodiments are for the sole purpose of illustration and not for the purpose of limitation.

I claim:

1. The method of removing and treating material from a combustion chamber which comprises: (1) providing an opening through the wall of a combustion chamber suitable for receiving a vacuum pickup element; (2) providing a movable closure on the inside of the combustion chamber wall within said combustion chamber and over said opening; (3) removably mounting a vacuum pickup element receiving means onto the outside of said combustion chamber wall and in alignment with said opening; (4) providing a vacuum pickup element movably located within said vacuum pickup element receiving means; (5) inserting said vacuum pickup element into said combustion chamber through said opening and past said movable closure; (6) providing a material quench bath means; (7) providing a conduit means between said quench bath means and said vacuum pickup element; (8) drawing by vacuum means the material from said combustion chamber through said vacuum pickup element, through said conduit means and into said quench bath means; and (9) storing said quenched material in a storage means.

2. Apparatus for removing and treating material from a combustion chamber through an opening in the wall of said combustion chamber which comprises: a movable closure means on the inside of said wall of said combustion chamber over said opening; a vacuum pickup element receiving means removably mounted on the outside of the wall of said combustion chamber aligned with said opening; a vacuum pickup element means movably located within said vacuum pickup element receiving means and insertable through said opening into said combustion chamber past said movable closure means; conduit means connected to said vacuum pickup element; storage means containing a quench bath means and connected to said conduit means; and a vacuum means for drawing said material from the inside of said combustion chamber, through said vacuum pickup element, through said conduit, and into said storage means containing said quench bath means.

* * * * *